US006730892B2

(12) United States Patent
Suda et al.

(10) Patent No.: US 6,730,892 B2
(45) Date of Patent: May 4, 2004

(54) RESISTIVE HEATING ELEMENT AND PRODUCTION METHOD

(75) Inventors: Yoshihisa Suda, Gunma (JP); Noboru Kanba, Gunma (JP); Atsushi Sato, Gunma (JP); Kunitaka Yamada, Gunma (JP)

(73) Assignee: Mitsubishi Pencil Co., Ltd., Tokyo (JP)

( * ) Notice: Subject to any disclaimer, the term of this patent is extended or adjusted under 35 U.S.C. 154(b) by 0 days.

(21) Appl. No.: 10/429,871

(22) Filed: May 6, 2003

(65) Prior Publication Data

US 2003/0222077 A1 Dec. 4, 2003

(30) Foreign Application Priority Data

May 9, 2002 (JP) ..... 2002-134362

(51) Int. Cl.[7] ..... H05B 3/44; H01B 1/04
(52) U.S. Cl. ..... 219/544; 252/502; 252/504
(58) Field of Search ..... 219/544, 548, 219/553; 252/502, 504

(56) References Cited

U.S. PATENT DOCUMENTS

| | | | | | |
|---|---|---|---|---|---|
| 3,906,926 | A | * | 9/1975 | Staples | 126/263.05 |
| 6,440,347 | B1 | * | 8/2002 | Izawa et al. | 264/262 |
| 6,497,829 | B2 | * | 12/2002 | Golan | 252/504 |
| 6,507,006 | B1 | * | 1/2003 | Hiramatsu et al. | 219/444.1 |
| 6,627,116 | B1 | * | 9/2003 | Suda et al. | 252/502 |
| 6,627,144 | B1 | | 9/2003 | Suda et al. | |

FOREIGN PATENT DOCUMENTS

| | | |
|---|---|---|
| JP | 2-38355 | 2/1990 |
| WO | WO 98/59526 | 12/1998 |

* cited by examiner

*Primary Examiner*—Edward K. Look
*Assistant Examiner*—Vinod D. Patel
(74) *Attorney, Agent, or Firm*—Foley & Lardner LLP

(57) ABSTRACT

A resistive heating element having high generation efficiency for far infrared rays and a comparatively high specific resistance while maintaining the strength required as a resistive heating element, is obtained by shaping a mixture of graphite powder, boron nitride and silicone rubber to a desired shape followed by firing by heating to 380° C. in an oxidizing atmosphere and then further firing by heating to 1100° C. in a nitrogen atmosphere.

4 Claims, No Drawings

RESISTIVE HEATING ELEMENT AND PRODUCTION METHOD

BACKGROUND OF THE INVENTION

1. Field of the Invention

The present invention relates to a resistive heating element and a production method.

2. Description of the Related Art

In the past, processed metal wire products such as tungsten wire and nichrome wire, machined products of carbon materials such as anisotropic carbon materials and glassy carbon materials, and metal compounds such as silicon carbide have been, primarily, used as resistive heating elements. Among these, processed metal wire products were mainly used as heating elements for the heaters of consumer appliances, while carbon and metal compounds were mainly used for industrial ovens and so forth.

Among these conventional heating element materials, carbon, different from metal wire and so forth, has advantageous characteristics such as a satisfactory heating rate, a satisfactory heating efficiency and a satisfactory far infrared ray generation efficiency. However, as conventional carbon heating elements are fabricated by machining them from large plates or blocks, the production process is not only complex and expensive, but it is also difficult to fabricate narrow or thin products. In addition, as products are machined from blocks and so forth having a specific resistance value within a certain standard range, there is the problem that changing the shape is the only way to control the heating value.

WO 98/59526 proposes a production method of a carbon-based heating element comprising mixing graphite powder and an electrical conductivity inhibitor of a metal or metalloid compound such as boron nitride or silicon carbide with a carbon-containing resin such as chlorinated vinyl chloride resin, and carbonizing the mixture in an inert gas such as nitrogen gas.

The carbon-based heating element obtained by this method has superior characteristics, as a carbon-based heating element, in that it allows a specific resistance to be controlled to an arbitrary value by changing the ratio of the carbon serving as a good electrical conductor to the metal or metalloid compound serving as an electrical conductivity inhibitor, and can be made into any arbitrary shape by shaping to the desired shape before carbonizing.

In the above carbon heating element, the generation efficiency of far infrared rays can be enhanced if it is possible to maintain the temperature of the heating element at a comparatively low temperature. In order to accomplish this, it is possible to increase the electrical resistance value by decreasing the cross-sectional diameter of the heating element, but this has limitations in terms of maintaining strength. It is also possible to increase the specific resistance value by increasing the blending ratio of metal or metalloid compound such as boron nitride, but this again results in the problem of a decrease in strength.

SUMMARY OF THE INVENTION

Thus, an object of the present invention is to provide a resistive heating element capable of easily realizing various shapes, such as thin plates, narrow rods or narrow cylinders, and imparting a high specific resistance value while maintaining a sufficient strength.

According to the present invention, a resistive heating element is provided that comprises a framework consisting essentially of silicon oxide, and crystalline carbon that fills the space within said framework.

This resistive heating element preferably additionally contains a metal or metalloid compounds.

According to the present invention, a heating device is also provided that is provided with a sealed container, the heating resistive element described above placed inside said sealed container, and inert gas filling said sealed container.

This resistive heating element is produced by mixing carbon powder with silicone rubber and shaping the mixture to a desired shape followed by firing.

In the mixing process, a metal or metalloid compounds are preferably additionally mixed in.

During firing, it is preferable to fire at a temperature of 300–400° C. followed by firing at a temperature of 1000–1400° C. in a non-oxidizing atmosphere.

The resistive heating element of the present invention has been confirmed to effectively solve the above problems, such as having superior generation efficiency of far infrared rays, by having a higher specific resistance value than the prior art while maintaining sufficient strength as a result of using silicon oxide for the framework and dispersing a carbon component as a good electrical conductor.

DESCRIPTION OF THE PREFERRED EMBODIMENTS

In general, as silicone rubber has a siloxane backbone in its structure, namely, as silicone rubber inherently has an —O—Si—O— backbone, which is a backbone of silicon oxide, it is possible to form a silicon oxide framework comparatively easily by firing.

Firing of a molding of a composition containing carbon and silicone rubber is carried out at a temperature of 300° C. or higher in an oxidizing atmosphere or non-oxidizing atmosphere, and preferably at a temperature of 360–400° C. in an oxidizing atmosphere and then at a temperature of 800–1400° C., and preferably a temperature of 1100–1400° C., in a non-oxidizing atmosphere.

If firing is carried out at a temperature below 300° C. in an oxidizing atmosphere, the resulting structure does not have sufficient strength due to inadequate formation of silicon oxide.

In addition, if firing is carried out at a temperature of 500° C. or higher in an oxidizing atmosphere, the carbon component serving as a good electrical conductor contained in the composition decomposes due to combustion and the fired composition becomes an insulator. Moreover, if firing is carried out at a temperature higher than 1400° C. in a non-oxidizing atmosphere, the crystal structure of the silicon carbide changes, resulting the possibility of a change in the characteristics.

Since deterioration of heating element characteristics or oxidation consumption of carbon materials may occur in the case of use at a temperature of more than about 500° C., it is preferable to put the heating element in a heat-resistant container such as a quartz tube, and to fill the container with an inert gas.

Either heat-vulcanized silicone rubber or liquid silicone rubber may be used as the silicone rubber in the present invention. These may be used alone or as a mixture of two or more types, and can be suitably selected according to the desired shape or molding method.

Any heat-vulcanized silicone rubber may be used for the heat-vulcanized silicone rubber capable of being used in the present invention as long as it is typically classified as a heat-vulcanized silicone rubber, examples of which include, but are not necessarily limited to, highly polymerized polyorganosiloxane (raw silicon rubber) mixed with a reinforcing filler such as dry silica or wet silica, an extending filler such as diatomaceous earth or quartz powder, a plasticizer having a comparatively low molecular weight such as polyorganosiloxane, or other additives.

Specific examples of heat-vulcanized silicone rubber that can be used include commercially available KE1551-U, KE1571-U, KE151-U, KE171-U, KE153-U, KE164-U, KE174-U, KE1261-U and KE904F-U (all of which are products of Shin-Etsu Silicone Co., Ltd.), and YE3465U, TSE2571-5U, TSE2571-7U, XE20-853U, XE20-A0784, TSE2323-5U, TSE2323-6U, TSE2323-7U, TSE2181U, TSE2183U and TSE2184U (all of which are products of GE Toshiba Silicone Co., Ltd.).

In addition, vulcanizing agents and so forth, in which a normally used organic peroxide is diluted into a paste form, may also be added depending on the molding conditions, desired shape and molding method.

Examples of vulcanizing agents include, but are not necessarily limited to, benzoylperoxide, 2,4-dichlorobenzoylperoxide, dicumylperoxide, 2,5-dimethyl-2,5-di(t-butylperoxy)hexane, p-chlorobenzoylperoxide, di-t-butylperoxide and t-butylperbenzoate, and these can be suitably selected in consideration of molding conditions and so forth.

Specific examples of vulcanizing agents include commercially available C-1, C-3, C-4, C-8, C-8A, C-8B, C-10, C-15, C-16, C-17, C-23 and C-25A/C-25B (all of which are products of Shin-Etsu Silicone Co., Ltd.), and TC-1, TC-3, TC-4, TC-8, TC-9, TC-12, TC-23A, TC-23B, TC-25A and TC-25B (all of which are products of GE Toshiba Silicone Co., Ltd.).

Any liquid silicon rubber may be used as the liquid silicone rubber in the present invention, as long as it is typically classified as liquid silicone rubber, or those silicone rubbers that are in a liquid state before curing (low-temperature curing type or room-temperature curing type) may also be used as the liquid silicon rubber in the present invention. Examples of the former include, but are not necessarily limited to, types composed of polymers such as polydimethylsiloxane, and reinforcing or extending inorganic fillers such as silica, crosslinking agents for enabling crosslinking, and catalysts, while specific examples that can be used include, but are not limited to, types in which curing proceeds by an addition reaction between polydimethylsiloxane having a vinyl group terminal (liquid A) and polydimethylsiloxane having a hydrogen atom bonded to a silicon atom (liquid B).

More specifically, examples of commercially available products include KE1950-10(A,B), KE2000-20(A,B), KE-1971-60(A,B), KE1990-40(A,B), KE1935(A,B) and KE1987(A,B) (all of which are products of Shin-Etsu Silicone Co., Ltd.), and TSE3221, TSE322SX, TSE3212, TSE3940, TSE3941, TSE3945, TSE3941M, TSE384-B, TSE3840-G, TSE3843-W, XE16-508, XE16-610, TSE3925, TSE3976-B, XE11-A1584, YE5505, YE5942 and YE5942K (all of which are products of Toshiba Silicone Co., Ltd.).

Any low temperature curing type silicone rubber may be used for the latter low temperature curing type as long as it is typically classified as a low-temperature curing type, and both one-liquid and two-liquid types may be used.

Example of low temperature curing types of the two-liquid type include those composed of, for example, a primary agent (liquid A) and a curing agent (liquid B). Specific examples of the primary agent (liquid A) are typically composed of polydiorganosiloxane (base polymer) having a vinyl group on its terminal and a curing catalyst such as a platinum compound, while examples of the curing agent (liquid B) are mainly composed of a crosslinking agent such as polyorganosiloxane having a hydrogen atom bonded to a silicon atom, and depending on the particular case, a base polymer may be additionally added to liquid B. Moreover, a filler or other additives may be added to both or one of the two liquids as necessary for the purpose of reinforcement or extension and so forth.

On the other hand, examples of low temperature curing types of the one-liquid type includes all of components of liquid A and liquid B (or primary agent and curing agent) from the beginning, and can be used with a curing retarding agent or other reaction control agent which control curing.

Specific examples of products that can be used include commercially available KE42, KE42S, KE420, FE123, KE45, KE441, KE45S, KE4525, KE402, KE4560, KE4576, KE4588, KE348, KE3475, KE3490, KE3491, KE3493, KE3494, KE4898, KE4890, KE4866, KE4805 and KE1830 (all of which are products of Shin-Etsu. Silicone Co., Ltd.).

Moreover, any room temperature curing type can be used as far as it is typically classified as a room temperature curing type, may be of one-component type or two-component type, and each may be of the condensation reaction type or addition reaction type.

Examples of room temperature curing type silicone rubber of the single component type include those composed of reactive polysiloxane, silica and other fillers, and a crosslinking agent, curing catalyst or other additives such as polyfunctional silane compounds having a hydrolysable group (such as an acetoxy group, alkoxy group or ketoxime group), and those types can be used in which a curing reaction occurs with moisture in the air.

On the other hand, examples of room temperature curing type silicone rubber of the two-component type that can be used include those of the type that are used by mixing a primary agent composed of polydiorganosiloxane having a functional group on its terminal (base polymer) and a crosslinking agent such as silane or siloxane having three or more functional groups, at a fixed ratio prior to use.

Examples of specific products that can be used include commercially available KE119, KE1091, KE1206, KE66, KE66SE, KE103, KE109(A,B), KE109E(A,B), KE1051(A,B), KE1204(A,B), KE10, KE12, KE17, KE20, KE111, KE1300 and KE1603(A,B) (which are all products of Shin-Etsu Silicone Co., Ltd.), and TSE3453, TSE3455T, TSE3456T, TSE3457T, YE5630, TSE3475T, TSE3477T, TSE3450, YE5626, TSE3466 and TSE3402 (which are all products of Toshiba Silicone Co., Ltd.).

The amount of silicone rubber contained in the composition of the present invention is required to be at least 10% by weight or more, preferably 20–100% by weight, and particularly preferably 30–60% by weight, with respect to the total amount of the composition.

If the silicone rubber content is less than 10% by weight, moldability and homogeneity during molding are remarkably impaired, making it difficult to obtain a molding of a fixed shape while also significantly lowering the strength of said molding, thereby making this undesirable.

Although examples of the previously mentioned carbon powder include carbon black, graphite and powdered coke, the type and amount of carbon powder used is suitably selected according to the resistance value and shape of the target heating element, and although the carbon powder may be used alone or as a mixture of two or more types, graphite is used particularly preferably in terms of the ease with which shape can be controlled.

Examples of the previously mentioned metal or metalloid compounds include typically easily available metal carbides, metal borides, metal silicides, metal nitrides, metal oxides, metalloid nitrides, metalloid oxides and metalloid carbides. The type and amount of metal or metalloid compounds used are suitably selected according to the resistance value and shape of the target heating element, and although the metal or metalloid compounds can be used alone or as a mixture of two or more types, boron carbide, silicon carbide, boron nitride and aluminum oxide are used particularly preferably in terms of the ease with which the resistance value can be controlled.

EXAMPLES

Example 1

| | |
|---|---|
| Heat-vulcanized silicone rubber KE1261-U (Shin-Etsu Silicone Co., Ltd.) | 50.0 parts |
| Boron nitride (Shin-Etsu Chemical Co., Ltd. Mean particle size: 5 μm) | 30.0 parts |
| Natural graphite fine powder (Nippon Graphite Co., Ltd., mean particle size: 5 μm) | 20.0 parts |
| C-23 (Shin-Etsu Silicon Co., Ltd.) | 1.5 parts |

After dispersing and mixing the above blended composition, the mixture was extruded into the shape of a narrow wire having a diameter of 3 mm, fired by heating to 380° C. in an oxidizing atmosphere, and then further fired by heating to 1100° C. in a nitrogen atmosphere to obtain a carbon/silicon oxide-based heating element in the shape of a rod. A cross-section of the resulting heating element had a diameter of 3 mm and a bending strength of 100 MPa. Measurement of specific resistance by the Wheatstone bridge method yielded a value of 1.3 Ω·cm.

When this carbon/silicon oxide-based heating element was connected to a lead and was electrified, radiation of far infrared rays was confirmed at the moment it reached 400° C. at 100 V. In addition, there was no formation of cracks during use, and a stable heating value could be obtained.

Example 2

A carbon/silicon oxide-based heating element having a rectangular cross-section was obtained in the same manner as Example 1 with the exception of molding the mixture into a rectangular shape having a thickness of 1.2 mm and width of 6 mm. A cross-section of the resulting heating element has a thickness of 1.2 mm, width of 6 mm, and bending strength of 87 MPa. Measurement of specific resistance by the Wheatstone bridge method yielded a value of 1.4 Ω·cm.

When this carbon/silicon oxide-based heating element was connected to a lead and was electrified, radiation of far infrared rays was confirmed at the moment it reached 400° C. at 100 V. In addition, there was no formation of cracks during use, and a stable heating value could be obtained.

Example 3

When a lead was connected to the end of the heating element obtained in Example 2 and the element was sealed in a quartz tube containing an argon gas atmosphere followed by electrification, radiation of far infrared rays was confirmed at the moment it reached 1000° C. at 200 V. In addition, there was no formation of cracks during use, and a stable heating value could be obtained.

Example 4

| | |
|---|---|
| Heat-vulcanized silicone rubber KE1261-U (Shin-Etsu Silicone Co., Ltd.) | 50.0 parts |
| Boron nitride (Shin-Etsu Chemical Co., Ltd. Mean particle size: 5 μm) | 20.0 parts |
| Natural graphite fine powder (Nippon Graphite Co., Ltd., mean particle size: 5 μm) | 30.0 parts |
| C-23 (Shin-Etsu Silicon Co., Ltd.) | 1.5 parts |

A carbon/silicon oxide-based heating element having a rectangular cross-section was obtained by processing the above composition in the same manner as Example 2. A cross-section of the resulting heating element had a thickness of 1.2 mm, width of 6 mm and bending strength of 110 MPa. Measurement of specific resistance by the Wheatstone bridge method yielded a value of 0.7 Ω·cm.

When this carbon/silicon oxide-based heating element was connected to a lead and was electrified, radiation of far infrared rays was confirmed at the moment it reached 430° C. at 100 V. In addition, there was no formation of cracks during use, and a stable heating value could be obtained.

Example 5

When a lead was connected to the end of the heating element obtained in Example 4 and the element was sealed in a quartz tube containing an argon gas atmosphere followed by electrification, radiation of far infrared rays was confirmed at the moment it reached 1100° C. at 200 V. In addition, there was no formation of cracks during use, and a stable heating value could be obtained.

Example 6

| | |
|---|---|
| Room temperature curing silicone rubber KE1300 (Shin-Etsu Silicone Co., Ltd.) | 50.0 parts |
| Boron nitride (Shin-Etsu Chemical Co., Ltd. Mean particle size: 5 μm) | 25.0 parts |
| Natural graphite fine powder (Nippon Graphite Co., Ltd., mean particle size: 5 μm) | 25.0 parts |
| CAT-1300 (Shin-Etsu Silicon Co., Ltd.) | 5.0 parts |

A carbon/silicon oxide-based heating element having a rectangular cross-section was obtained by processing the above composition in the same manner as Example 4. A cross-section of the resulting heating element had a thickness of 1.2 mm, width of 6 mm and bending strength of 95 MPa. Measurement of specific resistance by the Wheatstone bridge method yielded a value of 1.0 Ω·cm.

When this carbon/silicon oxide-based heating element was connected to a lead and was electrified, radiation of far infrared rays was confirmed at the moment it reached 400° C. at 100 V. In addition, when this heating element was sealed in a quartz tube containing an argon gas atmosphere followed by electrification, radiation of far infrared rays was confirmed at the moment it reached 1100° C. at 200 V. In addition, there was no formation of cracks during use, and a stable heating value could be obtained.

As has been described above, according to the present invention, a resistance heating element is provided having a prescribed shape, strength and electrical resistance value, while also being easily produced.

What is claimed is:

1. A resistive heating element comprising a framework consisting essentially of silicon oxide and crystalline carbon that fills a space within said framework.

2. The resistive heating element according to claim 1 further comprising metal or metalloid compounds.

3. A heating device comprising:

a sealed container;

a resistive heating element, placed inside the sealed container, including a framework consisting essentially of silicon oxide and crystalline carbon that fills a space within the framework; and inert gas filling the sealed container.

4. A heating device according to claim 3, wherein the resistive heating element further including metal or metalloid compounds.

* * * * *